US005706996A

United States Patent [19]

Lee

[11] Patent Number: 5,706,996

[45] Date of Patent: Jan. 13, 1998

[54] STAPLER GAS EXHAUST SYSTEM

[75] Inventor: Yun-Chung Lee, Taipei Hsien, Taiwan

[73] Assignee: De Poan Pneumatic Corporation, Taipei Hsien, Taiwan

[21] Appl. No.: 784,595

[22] Filed: Jan. 21, 1997

[51] Int. Cl.[6] ..... B25C 1/04

[52] U.S. Cl. ..... 227/130

[58] Field of Search ..... 227/130, 8, 10

[56] References Cited

U.S. PATENT DOCUMENTS

| | | | |
|---|---|---|---|
| 3,858,780 | 1/1975 | Perkins et al. | 227/130 |
| 4,609,135 | 9/1986 | Elliesen | 227/130 |
| 4,667,572 | 5/1987 | Elliesen | 227/130 |
| 5,131,579 | 7/1992 | Okushima et al. | 227/130 |
| 5,485,946 | 1/1996 | Jankel | 227/130 |

*Primary Examiner*—Scott A. Smith
*Attorney, Agent, or Firm*—Pro-Techtor International

[57] ABSTRACT

The present invention relates to a gas exhaust system for a stapler for ejecting nails, comprising: a cylinder with a vertically movable piston, driven down by high-pressure gas; a valve body, set on the top side of the cylinder, controlling the inflow of the high-pressure gas into the cylinder; and an exhaust, having a cavity, which is open to the bottom side and accommodates the valve body, and several exhaust holes, which are connected to the cavity, the exhaust having a vertical protection plate at a distance from the exhaust holes, its area covering the exhaust holes, the exhaust further having a protruding protection ring made of soft material on the outer side close to the bottom side; wherein, when the piston moves upwards to the original position, exhaust gas is released through the cavity and the exhaust holes, with the protection plate preventing the exhaust gas from directly hitting any object, and wherein the protection ring minimizes mechanically hitting the outer side of the exhaust and the cylinder of an object, thus avoiding injuries or damages.

3 Claims, 2 Drawing Sheets

STAPLER GAS EXHAUST SYSTEM

BACKGROUND OF THE INVENTION

1. Field of the Invention

The present invention relates to a gas exhaust system for a stapler, particularly to a protecting system, which prevents high-pressure exhaust gas from hitting the user.

2. Description of Related Art

In most conventional staplers, when a nail is ejected, high-pressure gas pushes a piston forward within a cylinder, the piston in turn driving a hammer for ejecting the nail. After ejecting the nail, the piston has to be brought back into its original position to be ready for the ejection of the next nail. For this purpose, the gas in the cylinder is removed by releasing it through holes in an exhaust system into the surrounding air. The released gas still has high pressure, stirring up dust and impairing the air quality. Thereby clothes and other objects get dirty, even the health of the user is endangered by breathing the exhaust gas or exposing the eyes to it. For this reason, rotatable exhaust systems have been devised, in order to control the direction of the outflow of the exhaust gas. The user then adjusts the direction according to working conditions. However, because of frequent careless use of the exhaust systems, these exhaust systems are still not safe.

SUMMARY OF THE INVENTION

The main object of the present invention is to provide an exhaust system for staplers, which is safe to use.

Another object of the present invention is to provide an exhaust system for staplers, which minimizes mechanically hitting the exhaust system by sensitive objects.

The present invention can be more fully understood by reference to the following description and accompanying drawings.

DETAILED DESCRIPTION OF THE PREFERRED EMBODIMENT

Figure 1:
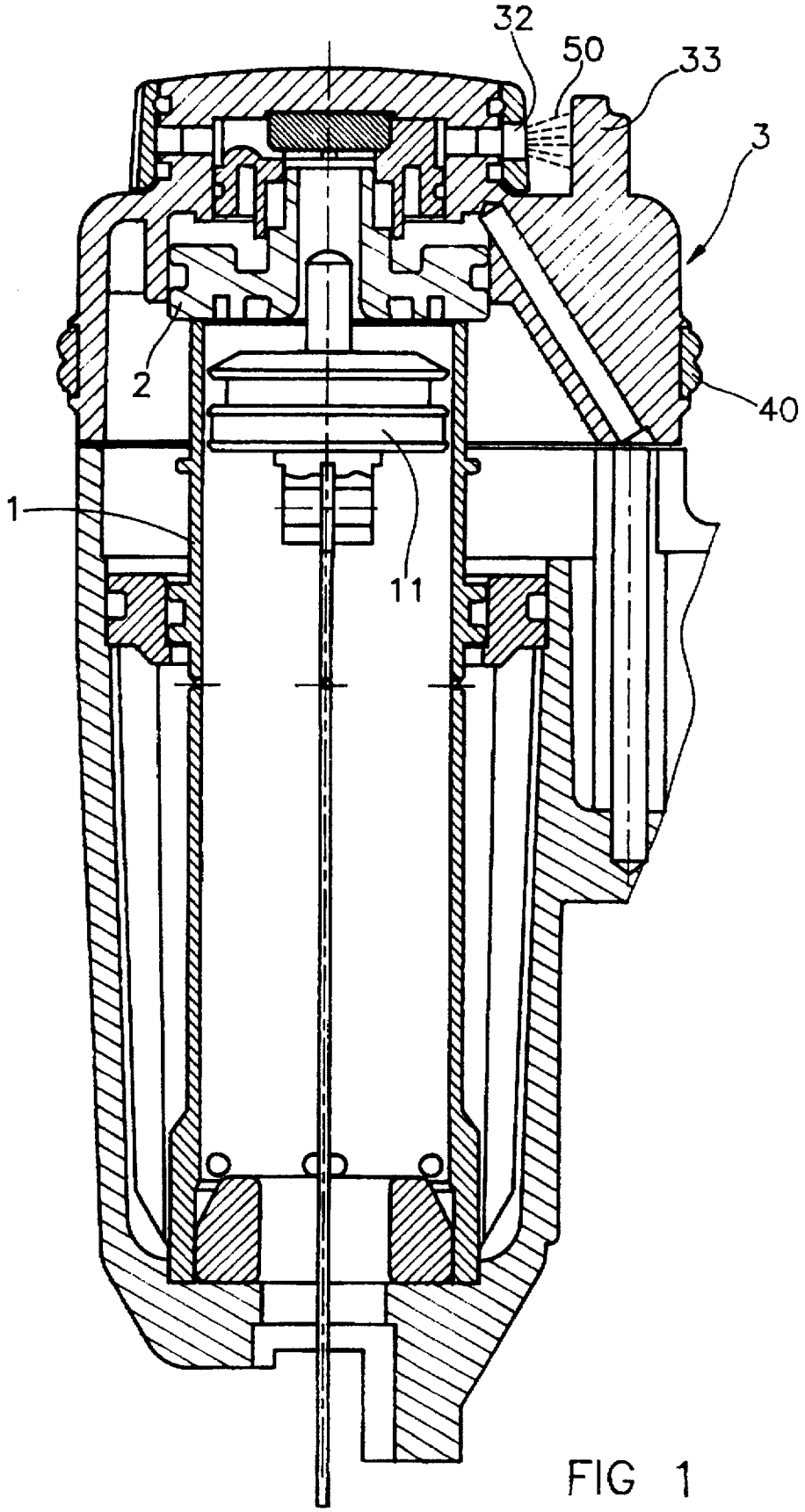
FIG. 1 is a longitudinal sectional view of the gas exhaust system of the present invention, showing the assembly of the structural parts thereof.

As shown in all Figures, the gas exhaust system for a stapler of the present invention has a cylinder 1, on the top of which a valve body 2 is set. The valve body 2 and the cylinder 1 are connected by a valve, which controls the inflow high-pressure gas 50 into the cylinder 1. The high-pressure gas 50 drives a piston within the cylinder 1 downward for ejecting a nail from the stapler. After ejecting the nail, the piston 11 returns to its original position to be ready for the ejection of the next nail. When the piston 11 moves upwards, the gas above the piston 11 is released through an exhaust 3 into the environment.

Figure 3:
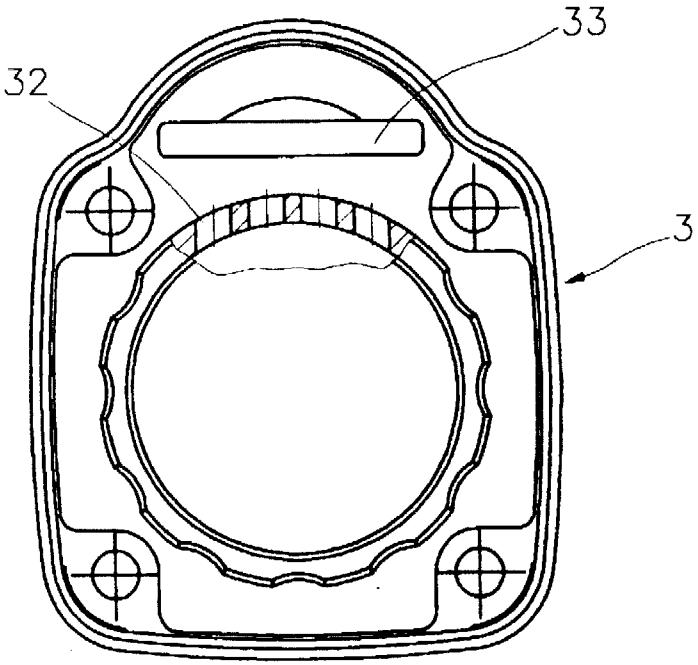
FIG. 3 is a planar sectional view of the exhaust of the present invention.
Figure 2:
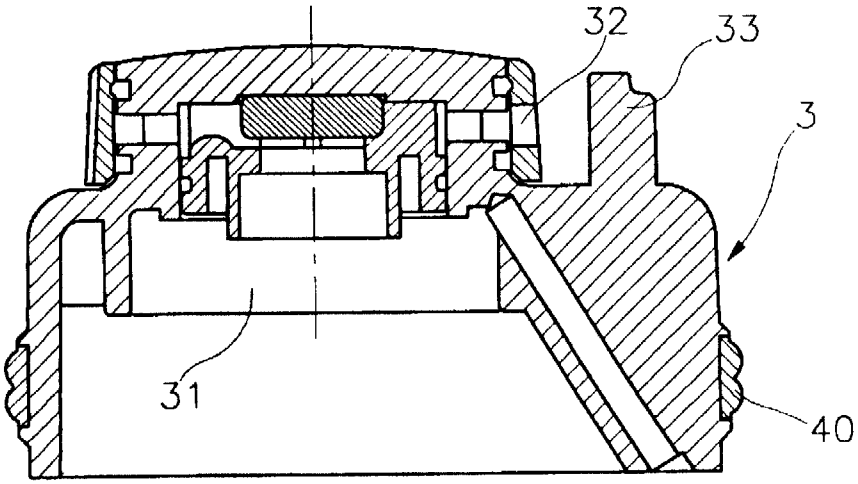
FIG. 2 is a longitudinal sectional view of the exhaust of the present invention.

As shown in FIGS. 1 to 3, the exhaust 3 is mounted on the top side of the cylinder 1, with its bottom side connected to the cylinder 1. The exhaust 3 has a cavity 31, which is open to the bottom side and accommodates the valve body 2. The exhaust 3 has a horizontal perimeter with several exhaust holes 32. The exhaust holes 32 are connected to the cavity 31, thus allowing for releasing exhaust gas into the environment, when the piston 1 moves upwards. The angular position of the exhaust holes 32 on the horizontal perimeter of the exhaust 3 is given by specific needs.

On the outer side of the exhaust 3 a protection plate 33 is mounted. It extends vertically upwards, its area covering the area of all exhaust holes 32. So exhaust gas released through the exhaust holes 32 will not directly hit any outside object, but, deflected by the protection plate 33, flow out on both sides of the protection plate 33 with less force. This prevents oily gas from contaminating clothes or hitting the eyes of the user.

Furthermore, a protection ring 40 is laid around the perimeter of the exhaust 3 close to the bottom side thereof. The protection ring 40 projects from the perimeter of the exhaust 3. It is made of soft material, like rubber. Thereby inadvertent hitting the connection of the cylinder 1 and the exhaust 3 is minimized, avoiding injuries or damaging sensitive work objects.

What is claimed is:

1. A gas exhaust system for a stapler for ejecting nails, comprising:

a cylinder with a vertical axis and a top side, said cylinder having a vertically movable piston with an original position close to said top side of said cylinder, said piston moving down, driven by high-pressure gas, so as to drive the ejection of one of said nails, and moving up to said original position thereafter;

a valve body, set on said top side of said cylinder, controlling the inflow of said high-pressure gas into said cylinder; and an exhaust with a bottom side and an outer side, said bottom side mounted on said top side of said cylinder, said exhaust having a cavity, which is open to said bottom side and accommodates said valve body, said exhaust having a horizontal perimeter with a plurality of exhaust holes, which are connected to said cavity, said exhaust having a vertical protection plate at a distance from said exhaust holes,said protection plate having an area that covers said exhaust holes, said exhaust further having a protruding protection ring made of soft material on said outer side close to said bottom side;

wherein, when said piston moves upwards to said original position, exhaust gas is released through said cavity and said exhaust holes, with said protection plate preventing said exhaust gas from directly hitting any object, and wherein said protection ring minimizes mechanically hitting said outer side of said exhaust and said cylinder by an object, thus avoiding injuries or damages.

2. A gas exhaust system according to claim 1, wherein said protection plate extends from said exhaust.

3. A gas exhaust system according to claim 1, wherein said protection ring protrudes from said outer side of said exhaust.

* * * * *